US009460727B1

(12) United States Patent
Jing et al.

(10) Patent No.: US 9,460,727 B1
(45) Date of Patent: Oct. 4, 2016

(54) AUDIO ENCODER FOR WIND AND MICROPHONE NOISE REDUCTION IN A MICROPHONE ARRAY SYSTEM

(71) Applicant: GoPro, Inc., San Mateo, CA (US)

(72) Inventors: Zhinian Jing, Belmont, CA (US); Scott Patrick Campbell, Belmont, CA (US)

(73) Assignee: GoPro, Inc., San Mateo, CA (US)

( * ) Notice: Subject to any disclaimer, the term of this patent is extended or adjusted under 35 U.S.C. 154(b) by 0 days.

(21) Appl. No.: 14/789,683

(22) Filed: Jul. 1, 2015

(51) Int. Cl.

| | |
|---|---|
| ***H04R 3/00*** | (2006.01) |
| ***G10L 19/00*** | (2013.01) |
| ***G10L 19/008*** | (2013.01) |
| ***H04R 1/40*** | (2006.01) |
| ***H04R 3/04*** | (2006.01) |
| ***H04R 5/04*** | (2006.01) |

(52) U.S. Cl.
CPC ..... *G10L 19/008* (2013.01); *H04R 1/406* (2013.01); *H04R 3/005* (2013.01); *H04R 3/04* (2013.01); *H04R 5/04* (2013.01); *H04R 2201/401* (2013.01); *H04R 2203/12* (2013.01); *H04R 2410/03* (2013.01); *H04R 2410/05* (2013.01); *H04R 2410/07* (2013.01)

(58) Field of Classification Search
None
See application file for complete search history.

(56) References Cited

U.S. PATENT DOCUMENTS

| | | | | |
|---|---|---|---|---|
| 5,349,386 | A * | 9/1994 | Borchardt | H04R 5/033 381/4 |
| 8,463,141 | B2 * | 6/2013 | Liu | H04B 10/2513 398/203 |
| 8,995,681 | B2 * | 3/2015 | Kimura | G10L 21/034 381/94.1 |
| 9,202,475 | B2 * | 12/2015 | Elko | H04R 3/005 |
| 9,301,049 | B2 * | 3/2016 | Elko | H04R 3/005 |
| 2003/0008616 | A1 * | 1/2003 | Anderson | H04B 1/1646 455/45 |
| 2008/0260175 | A1 * | 10/2008 | Elko | H04R 3/005 381/73.1 |
| 2009/0043591 | A1 * | 2/2009 | Breebaart | G10L 19/008 704/500 |
| 2011/0085671 | A1 * | 4/2011 | Gibbs | G10L 19/008 381/23 |
| 2013/0142343 | A1 * | 6/2013 | Matsui | G10L 21/028 381/56 |
| 2015/0181329 | A1 * | 6/2015 | Mikami | H04R 3/005 381/71.11 |

* cited by examiner

*Primary Examiner* — Thang Tran
(74) *Attorney, Agent, or Firm* — Fenwick & West LLP

(57) ABSTRACT

An audio system encodes and decodes audio captured by a microphone array system in the presence of wind noise. The encoder encodes the audio signal in a way that includes beamformed audio signal and a "hidden" representation of a non-beamformed audio signal. The hidden signal is produced by modulating the low frequency signal to a high frequency above the audible range. A decoder can then either output the beamformed audio signal or can use the hidden signal to generate a reduced wind noise audio signal that includes the non-beamformed audio in the low frequency range.

21 Claims, 6 Drawing Sheets

AUDIO ENCODER FOR WIND AND MICROPHONE NOISE REDUCTION IN A MICROPHONE ARRAY SYSTEM

BACKGROUND

1. Technical Field

This disclosure relates to audio processing, and more specifically, to encoding and decoding audio signals in the presence of wind and microphone noise.

2. Description of the Related Art

In a directional audio or video recording system, a beamformed audio signal can be generated from audio captured by a microphone array with two or more omni-directional closely-spaced microphones. The beamformed audio signal can be used to create effects such as stereo recording or audio zoom. However directional microphone systems traditionally have an undesirable side-effect of increasing wind noise in the low frequency range of the beamformed audio signal.

BRIEF DESCRIPTIONS OF THE DRAWINGS

The disclosed embodiments have other advantages and features which will be more readily apparent from the following detailed description of the invention and the appended claims, when taken in conjunction with the accompanying drawings, in which:

Figure (or "FIG.") 1 is a block diagram illustrating an example embodiment of an audio system.

DETAILED DESCRIPTION

Figure 1:
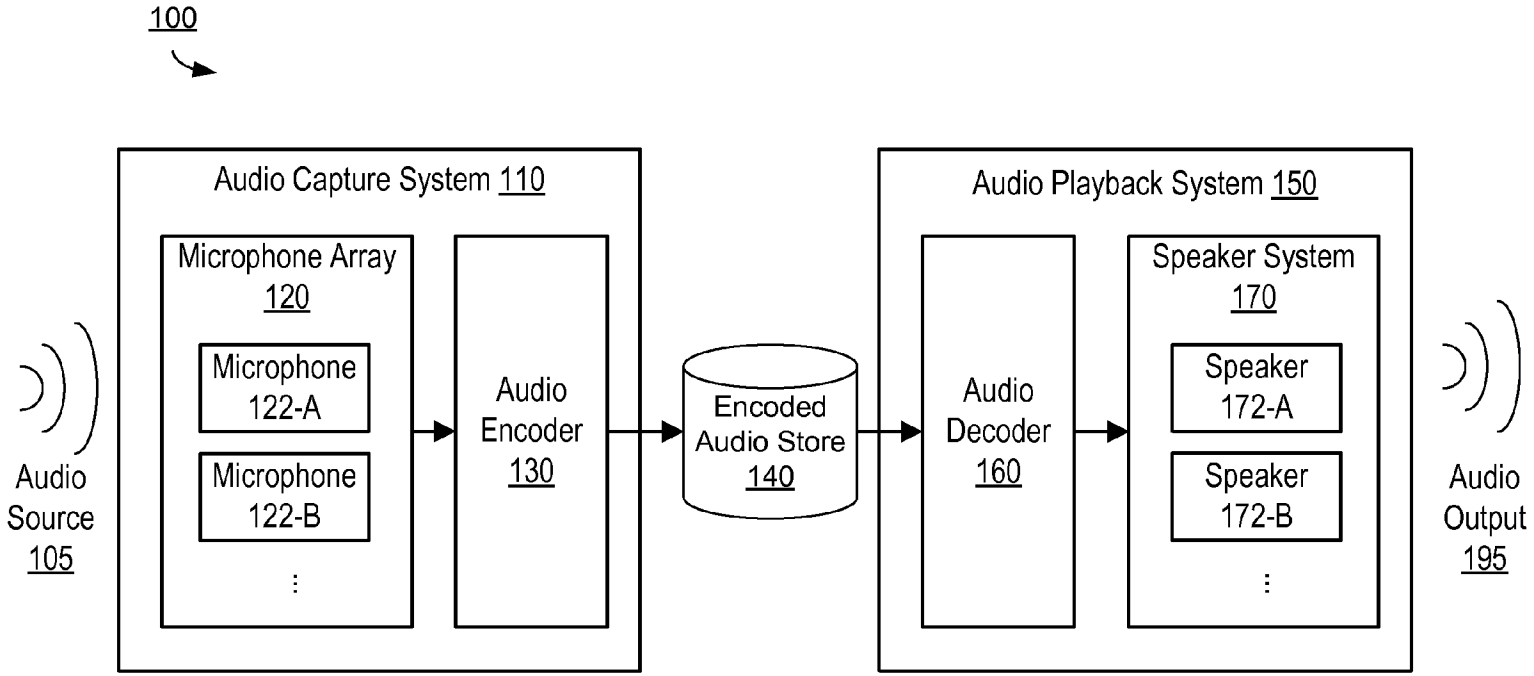

The figures and the following description relate to preferred embodiments by way of illustration only. It should be noted that from the following discussion, alternative embodiments of the structures and methods disclosed herein will be readily recognized as viable alternatives that may be employed without departing from the principles of what is claimed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

Configuration Overview

An audio system encodes and decodes audio captured by a microphone array system in the presence of wind noise. The encoder encodes the audio signal in a way that includes a beamformed audio signal and a "hidden" representation of a non-beamformed audio signal. The hidden signal is produced by reducing the level and modulating a low frequency portion of the non-beamformed audio signal where wind noise is present to a high frequency above the audible range. A decoder can then either output the beamformed audio signal or can use the hidden signal to generate a reduced wind noise audio signal that includes the non-beamformed audio in the low frequency portion of the signal.

In a particular embodiment, an audio encoder obtains a first audio signal from a first microphone of a microphone array and obtains a second audio signal from a second microphone of the microphone array. The audio encoder combines the first audio signal and the second audio signal to generate a beamformed audio signal. A selected audio signal is determined having a lower wind noise metric between the first audio signal and the second audio signal. The selected audio signal is processed to modulate the selected audio signal based on a high frequency carrier signal to generate a high frequency signal. In an embodiment, the selected audio signal may also be level limited to further reduce audibility. The high frequency signal and the beamformed audio signal are combined to generate an encoded audio signal.

At the audio decoder, the encoded audio signal is received. The encoded audio signal represents a non-beamformed audio signal modulated from a low frequency range to a high frequency range and combined with a beamformed audio signal spanning the low frequency range and a mid-frequency range between the low frequency range and the high frequency range. Responsive to receiving an input to recover the beamformed audio signal, the audio decoder applies a low pass filter to the encoded audio signal to filter out the non-beamformed audio signal to generate an original audio signal. Responsive to receiving an input to recover a reduced wind noise audio signal, the audio decoder processes the encoded audio signal to generate the reduced wind noise audio signal. The reduced wind noise audio signal represents the non-beamformed audio signal in the low frequency range and the beamformed audio signal in the mid-frequency range.

For example, in one embodiment, the audio decoder band-pass filters the encoded audio signal according to a first band-pass filter corresponding to the high frequency range to obtain the band-passed non-beamformed signal. The audio decoder then amplifies the band-passed filtered signal to generate an amplified first band-pass filtered signal. The audio decoder demodulates the amplified first band-pass filtered signal based on a carrier signal to recover the non-beamformed audio signal in the low frequency range. The audio decoder band-pass filters the encoded audio signal according to a second band-pass filter corresponding to the mid-frequency range to recover a band-passed portion of the beamformed audio signal in the mid-frequency range. The audio decoder then combines the recovered non-beamformed audio signal in the low frequency range with the recovered band-passed portion of the beamformed audio signal in the mid-frequency range to generate the decoded audio signal.

Example Audio System

FIG. 1 illustrates an example audio system 100 including an audio capture system 110, an encoded audio store 140, and an audio playback system 150. The audio capture system 110 captures audio from an audio source 105 which may include a desired signal and undesired wind noise, microphone noise, or other low frequency noise. The audio capture system 110 encodes the captured audio to generate an encoded audio signal, which may be stored to the encoded audio store 140. The audio playback system 150 receives an encoded audio signal from the encoded audio store 140, decodes the encoded audio signal, and generates an audio output 195. In various embodiments, all or parts of the audio capture system 110 may be embodied in a standalone device or as a component of a mobile device, camera, or other computing device. Similarly, all or parts of the audio playback system 150 may be embodied in a standalone device or as a component of a mobile device, camera, or other computing device. Furthermore, all or parts of the audio capture system 110 and audio playback system 150 may be integrated within the same device. The encoded audio store 140 may integrated in a device with one or more components of the audio capture system 110, the audio playback system 150, or both. In other embodiments, the encoded audio store 140 may comprise, for example, a local storage device, a network-based cloud storage system, or other storage. In an embodiment, a communication channel may be included in place of the encoded audio store 140, thus enabling encoded audio to be communicated directly from audio capture system 110 to the audio playback system 150.

The audio capture system 110 comprises a microphone array 120 and an audio encoder 130. The microphone array 120 comprises two more microphones 122 (e.g., microphones 122-A, 122-B, etc.) that capture audio from the audio source 105. In one embodiment, the microphones 122 comprise two or more closely-spaced omnidirectional microphones having a known physical distance between them. Alternatively, the microphones 122 can include directional microphones or a combination of directional and omnidirectional microphones. The audio encoder 130 encodes the signals from the different microphones to generate an encoded audio signal which may be stored to the encoded audio store 140. In an embodiment, the audio encoder 130 comprises a processor (e.g., a general purpose processor or a digital signal processor) and a non-transitory computer readable storage medium that stores instructions that when executed by the processor carries out the encoding process described herein. Alternatively, the audio encoder 130 may be implemented in hardware, or as a combination of hardware, software, and firmware.

The audio playback system 150 comprises an audio decoder 160 and a speaker system 170 comprising one or more speakers 172 (e.g., speaker 172-A, 172-B, etc.). The audio decoder 160 receives an encoded audio signal from the encoded audio store 140 and generates a decoded audio signal that can be played by the speaker system 170 to produce the audio output 195. In one embodiment, the audio output 195 may comprise, for example, a stereo or multidirectional audio output from a plurality of speakers 172. In an embodiment, the audio decoder 160 comprises a processor (e.g., a general purpose processor or a digital signal processor) and a non-transitory computer readable storage medium that stores instructions that when executed by the processor carries out the decoding process described herein. Alternatively, the audio decoder 160 may be implemented in hardware, or as a combination of hardware, software, and firmware.

In one embodiment, the audio encoder 130 combines the signals from the different microphones 122 to form a beamformed audio signal. For example, in one embodiment, the audio signals from the two microphones are combined using a delay and subtraction method to form a simple $1^{st}$-order cardiod given by:

$$V(t)=O1(t)-O2(t)\cdot Z^{-\tau} \quad (1)$$

where V(t) is the combined signal, O1($t$) is the audio signal from a first microphone 122-A, O2($t$) is the audio signal from a second microphone 122-B, and $Z^{-\tau}$ represents the time for sound to travel the distance between the first microphone 122-A and the second microphone 122-B. For audio signals that are substantially correlated between the microphones (e.g., most non-noise signals that represent the desired source of audio), the delay and subtraction method described in Equation (1) creates a drop in signal level for low frequency sound. For example, a simple 1st-order cardioid formed from two microphones spaced one centimeter apart has a frequency response that is similar to that of a 1st-order high pass Butterworth filter with cutoff frequency of 3 kHz. However, the high-pass filter effect introduced by the delay and subtraction method of equation (1) generally does not affect wind noise or other microphone noise, which is typically concentrated below 4 kHz. This is because wind noise is created by air turbulence at the microphone membranes and is substantially uncorrelated at the different microphones. In order to compensate for the high-pass filter effect on the non-wind noise low-frequency sounds, the audio encoder 130 may apply equalization that is more low pass to make the overall response flat again. However, a side effect of this equalization is that it also brings up the wind noise. As a result, wind noise in beamformed audio tends to be high relative to the desired non-noise signal.

To eliminate the problem of increased wind noise in beamformed signals, in some instances it may desirable to only form the beamformed signal (using Equation (1)) in frequency ranges where wind noise is not present (e.g., above 4 kHz) and to use one of the original omnidirectional microphone outputs (e.g., O1 or O2 in Equation (1)) in the low frequency range. In this case, the noise performance at low frequencies may be improved at the expense of losing the directionality of the audio signal in the low frequency range. In other instances, however, the wind noise at low frequencies may not be problematic and it may instead be more desirable to retain the directionality of the signal. In order to manage this trade-off, the audio encoder 130 produces a signal that enables the audio decoder 160 to selectively produce an audio output 195 that either includes a directional or non-directional audio component in the low frequency range where noise is present. Particularly, in one embodiment, the audio encoder 130 combines the beamformed signal produced by Equation (1) with an inaudible representation of the low frequency components of the original microphone signal. The inaudible representation may be generated by modulating the low frequency component of an original microphone signal to a high frequency range outside the audible range and/or by level-limiting the signal. Because the encoded audio signal includes both the beamformed low frequency component and the original low frequency component (which is hidden by modulating it to a high frequency range and/or level-limiting to an inaudible level), the audio decoder 160 can selectively process the encoded audio signal to either reconstruct a reduced wind noise signal without beamforming in the low frequency range or to simply remove the hidden signal and output a fully beamformed audio signal. Furthermore, in the case where the encoded audio signal is played directly without decoding (e.g., if sent to an audio playback system 150 without the capability of processing the hidden signal), the hidden signal will not be heard since it is level-limited and/or modulated to an inaudible high frequency band.

Figure 2:
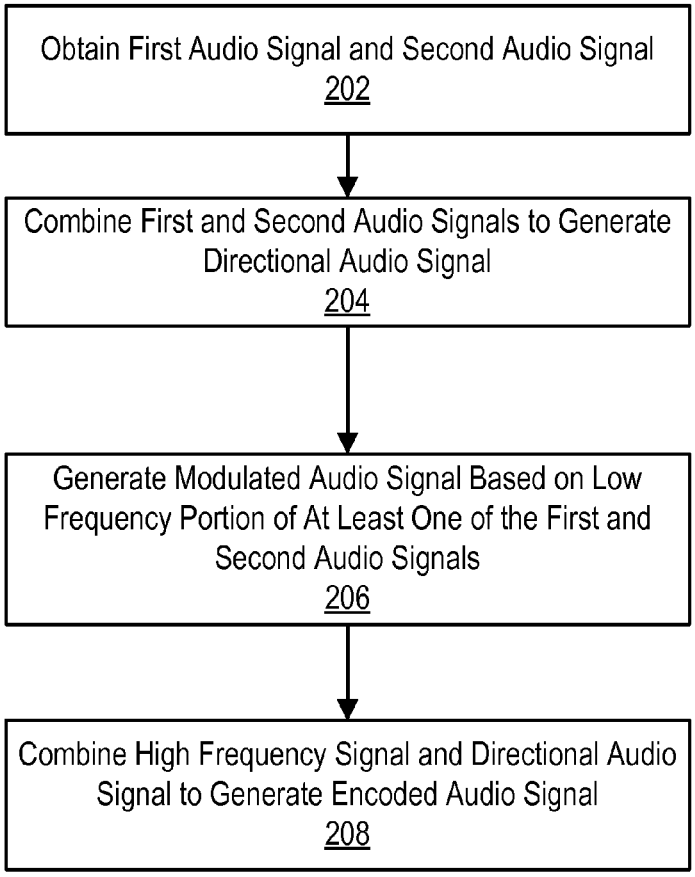
FIG. 2 is a flowchart illustrating an example embodiment of a process for generating an encoded audio signal.

FIG. 2 is a flowchart illustrating an example embodiment of a process for generating an encoded audio signal. The audio encoder 130 obtains 202 a first audio signal and a second audio signal (e.g., from microphone array 120). The audio encoder 130 combines 204 the first and second audio signals to generate a beamformed audio signal. The beamformed audio signal has the characteristic of having increased wind noise in the low frequency range. The audio encoder 130 also generates 206 a modulated audio signal based on a low frequency portion of at least one of the original audio signals that is modulated to a high frequency outside the audible range. The audio encoder 130 combines 208 the modulated audio signal and the beamformed audio signal to generate the encoded audio signal. For example, in one embodiment, the encoded audio signal is given by:

$$V'(t)=V(t)+f(\min(O1(t),\ O2(t))) \quad (2)$$

Here, the operation min(O1(*t*), O2(*t*)) determines the input having a lower wind noise metric between O1(*t*) and O2(*t*). For example, in one embodiment, the energy levels of O1(*t*) and O2(*t*) are compared on a block-by-block basis and the signal having the lower wind noise is selected for each block. The function *f* ( ) performs an operation of low-pass filtering, optionally level-limiting, and modulating the selected signal to a high frequency range above the audible range (e.g., above 20 kHz). For example, in one embodiment, a low-pass filter having a cutoff frequency of approximately 4 kHz is applied and the signal in the low frequency range 0-4 kHz is modulated to 20-24 kHz. This operation therefore hides the low frequency wind noise by pushing it to an inaudible frequency range. Furthermore, in one embodiment, a 24-bit PCM format signal is level-limited to, for example, the 12 least-significant bits.

Figure 3:
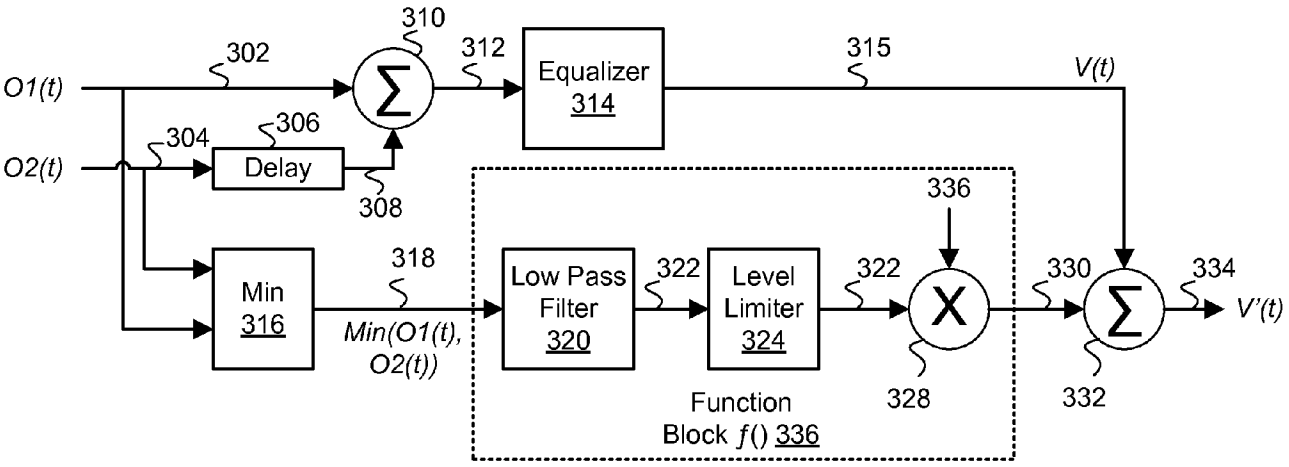
FIG. 3 is a block diagram illustrating an example embodiment of an audio encoder.

FIG. 3 is a block diagram illustrating an example embodiment of an audio encoder 130 for an audio capture system 110 having two microphones 122 that operates according to the process of FIG. 2. A second audio signal O2(*t*) is delayed by a delay block 306 to generate a delayed audio signal 308 and combined with the first audio signal 302 by a combining circuit 310 to generate a combined audio signal 312. An effect of combining is that the amplitude of correlated (i.e., not wind noise) low-frequency components of the combined signal 312 are reduced relative to the original signals 302, 304. Equalizer 314 equalizes the combined audio signal 312 to boost low frequency components of the combined signal 312 to generate an equalized signal 315. The equalized signal 315 has a flat the response for correlated components of the audio signals relative to the original audio signals 302, 304 but has increased amplitude of low frequency non-correlated (e.g., wind noise) components.

To generate the hidden component of the encoded output signal, a "Min" block 316 compares the low frequency energies of the original audio signals 302, 304 and selects the signal having the lower wind noise as selected signal 318. In an embodiment, the Min block 316 may operate on a block-by-block basis so that the output signal 318 is not necessarily entirely from one of the audio signals O1(*t*), O2(*t*) but instead passes through the signal having lower wind after each block comparison. A function block 336 then performs the function *f* ( ) described above. For example, in one embodiment, the function block 336 includes a low pass filter 320, a level limiter 324, and a modulator 328. The low pass filter 320 filters the selected signal 318 to generate low pass filtered signal 322. The level limiter 324 level limits the low pass filtered signal 322 to generate a level-limited signal 326. The modulator 328 modulates the level-limited signal 326 onto a high frequency carrier signal 336 outside the audible range to generate a modulated signal 330. A combiner 332 then combines the modulated signal 330 with the equalized signal 315 to form the encoded output signal 334.

In alternative embodiments, the level limiter 324 may be omitted. In other embodiments, the level limiter 324 may be implemented prior to the low pass filter 320 or after the modulator 328.

Figure 4:
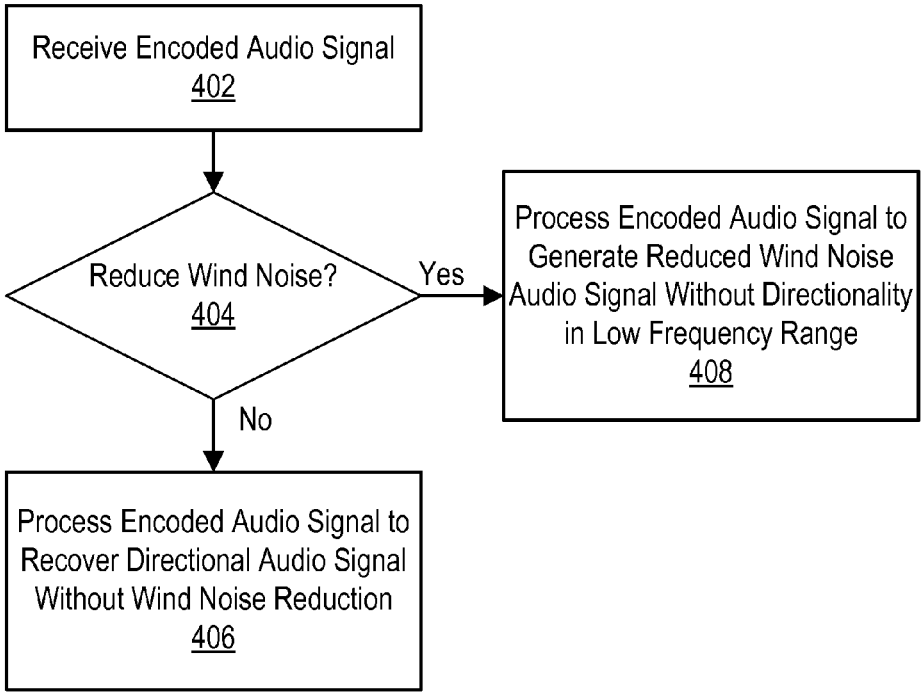
FIG. 4 is a flowchart illustrating an example embodiment of a process for decoding an encoded signal.

FIG. 4 is a flowchart illustrating an embodiment of a process performed by the audio decoder 160 to decode an encoded signal. The audio decoder 160 receives 402 an encoded signal. The audio decoder 160 then determines 404 whether to generate an output signal having reduced wind noise (e.g., by removing directionality from the low frequency range) or whether to output the fully beamformed audio signal. In one embodiment, the decision may be made based on user input. For example, using a video or audio editor interface, a user may be able to select the decoding method depending on which version is preferable for a given situation. Alternatively, the decision may be made automatically at the audio decoder 160. For example, the audio decoder 160 may select which output to produce based on the level of wind noise present in the signal or based on predefined preferences set by the user. If the audio decoder 160 determines not to output the reduced wind noise signal, the audio decoder 160 processes 406 the encoded audio signal to recover the fully direction audio signal without wind noise reduction. For example, in this case the audio decoder 160 removes the hidden signal f (min(O1(*t*), O2(*t*))) signal and outputs V(t). Alternatively, the audio decoder 160 may output V' (t) directly since the hidden component is inaudible and therefore does not necessarily need to be removed. If the audio decoder 160 instead determines 404 to output a reduced wind noise version of the signal, the audio decoder 160 processes 408 the encoded audio signal to generate a reduced wind noise audio signal with no or reduced directionality in the low frequency range. For example, in one embodiment, the audio decoder constructs a reduced wind-noise signal V~(t) as:

$$V^{\sim}(t)=g1(V')+g2(V') \quad (3)$$

In Equation (3), g1 (V') is a band-limited portion of the beamformed audio signal in a mid-frequency range above the cut-off frequency of the low pass filter 320 applied by the encoder 130 (e.g., above 4 kHz) and below carrier frequency used in the modulator 336 of the encoder 130 (e.g., below 20 kHz). Thus, for example, in one embodiment the mid-frequency range comprises the range 4 kHz-20 kHz. Furthermore, in Equation (3), the function g2( ) reverses the operations performed by the encoder 130 to produce the hidden signal such that g2(V')=min(O1(*t*), O2(*t*)).

Figure 5:
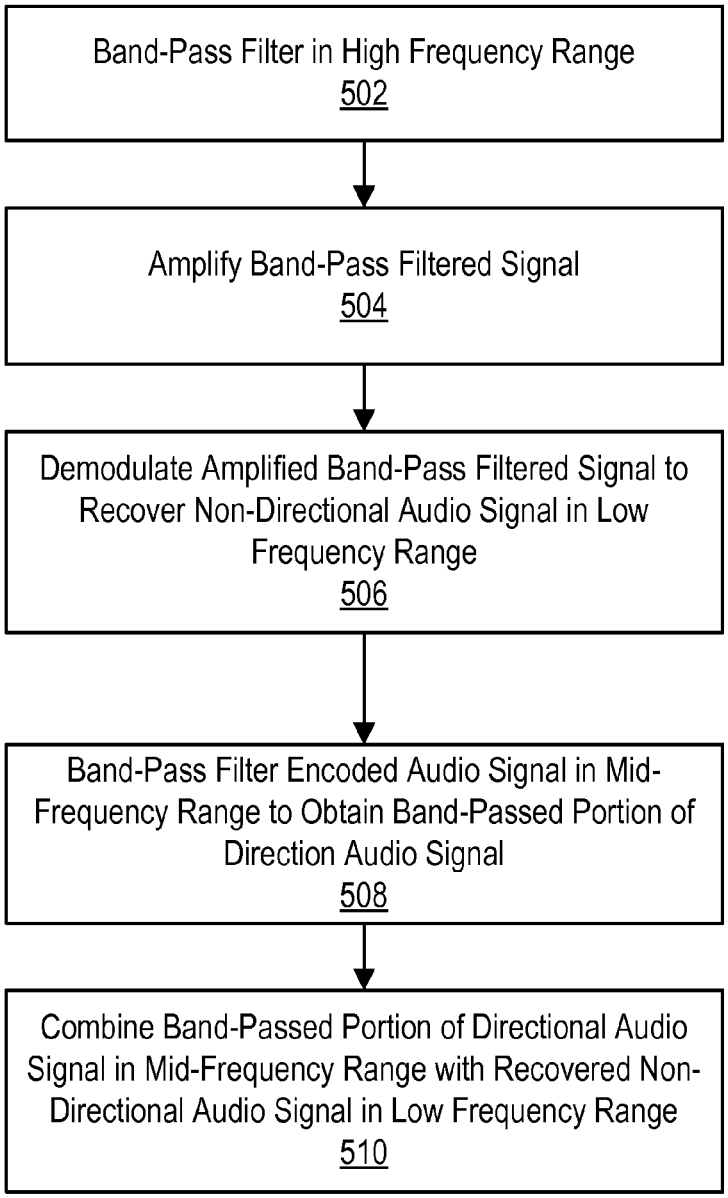
FIG. 5 is a flowchart illustrating an embodiment of a process for generating a reduced wind noise audio signal from an encoded audio signal.

FIG. 5 is a flowchart illustrating an embodiment of a process for generating the reduced wind noise audio signal at the audio decoder 160. The audio decoder 160 band-pass filters 502 the encoded signal using a band-pass filter corresponding to the frequency range of the hidden signal f (min(O1(*t*), O2(*t*))). For example, in one embodiment, the band-pass filter extracts a signal in the frequency range 20 kHz-24 kHz, which corresponds to the frequency range where the wind noise is hidden. The audio decoder 160 then amplifies 504 the band-pass filtered signal to reverse the level-limiting applied at the encoder 130. The audio decoder 160 demodulates 506 the amplified band-pass filtered signal (e.g., to the range 0-4 kHz) to recover the non-beamformed audio signal in the low frequency range given by g2 (V') =min(O1(*t*), O2(*t*)). The audio decoder 160 also band-pass filters 508 the encoded audio signal in a mid-frequency range between the low frequency range and high frequency range (e.g., 4 kHz-20 kHz) to obtain a band-passed portion of the beamformed audio signal g1(V'). The audio decoder 160 combines 510 the band-passed portion of the beamformed audio signal in the mid-frequency range with the recovered non-beamformed audio signal in the low frequency range to produce the decoded audio signal with reduced wind noise.

Figure 6:
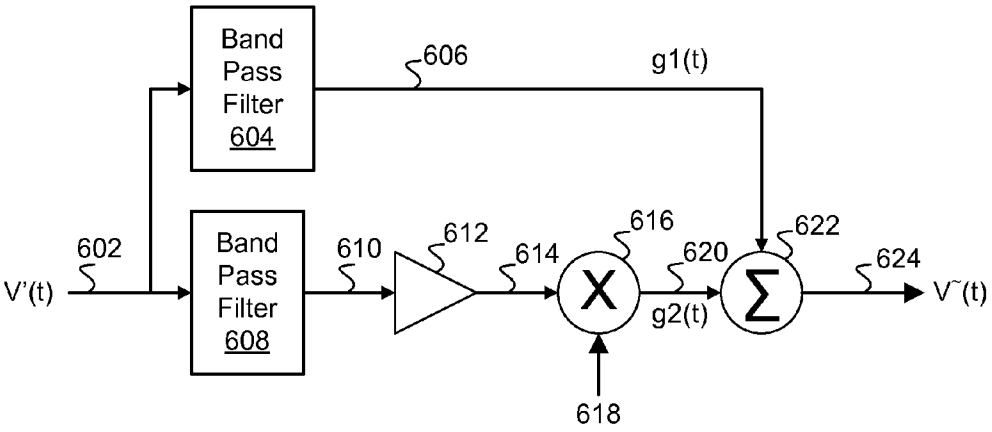
FIG. 6 is a block diagram illustrating an example embodiment of an audio decoder.

FIG. 6 illustrates an embodiment of an audio decoder 160 for performing the process of FIG. 5. A first band-pass filter 604 band-pass filters the encoded signal V'(t) 602 to generate a first band-limited signal g1(*t*) 606 comprising a portion of the beamformed audio signal corresponding to a mid-frequency range. For example, in one embodiment, the first band pass filter 604 has low and high cutoff frequencies of approximately 4 kHz and 20 kHz respectively. A second band pass filter 608 band-pass filters the encoded signal V'(t) 602 to generate a second band-limited signal 610 comprising a portion of the beamformed audio signal corresponding to a high frequency range above the audible range where the hidden signal is present. For example, in one embodiment, the second band pass filter 608 has low and high cutoff frequencies of 20 kHz and 24 kHz respectively. An amplifier 612 amplifies the second band-limited signal 610 to generate an amplified signal 614 which is demodulated by demodulator 616 according to a carrier frequency 618 to generate a demodulated signal 620 corresponding to g2(*t*). For example, in one embodiment, the demodulator 616 demodulates the amplified signal 614 to a frequency range 0-4 kHz. A combiner 622 combines the first band-limited signal g1(*t*) 606 and the demodulated signal g2(*t*) 620 to generate the decoded signal 624. In one embodiment, the combiner 622 may apply a frequency-dependent weighted summation of the signals 606, 620.

Additional Configuration Considerations

Throughout this specification, as used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus.

In addition, use of the "a" or "an" are employed to describe elements and components of the embodiments herein. This is done merely for convenience and to give a general sense of the invention. This description should be read to include one or at least one and the singular also includes the plural unless it is obvious that it is meant otherwise.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Upon reading this disclosure, those of skill in the art will appreciate still additional alternative structural and functional designs for the described embodiments as disclosed from the principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the scope defined in the appended claims.

The invention claimed is:

1. A method for encoding an audio signal captured by a microphone array system in the presence of wind noise, the method comprising:

capturing at least a first audio signal via a first microphone of a microphone array and a second audio signal via a second microphone of the microphone array;

combining the first audio signal and the second audio signal to generate a beamformed audio signal;

determining a selected audio signal having a lower wind noise metric between the first audio signal and the second audio signal;

processing the selected audio signal to modulate the selected audio signal based on a high frequency carrier signal to generate a high frequency signal; and combining the high frequency signal and the beamformed audio signal to generate an encoded audio signal.

2. The method of claim 1, where at least one of the first microphone and the second microphone comprise an omni-directional microphone.

3. The method of claim 1, wherein processing the selected audio signal further comprises:

low pass filtering and level-limiting the selecting audio signal.

4. The method of claim 1, wherein processing the selected audio signal further comprises:

applying a low pass filter having a cutoff frequency of approximately 4 kHz.

5. The method of claim 1, wherein the high frequency carrier signal has a frequency of at least 20 kHz.

6. The method of claim 1, wherein determining the selected audio signal having the lower wind noise metric comprises:

performing a comparison of an energy level of the first audio signal with an energy of the second audio signal within a low frequency range in which wind noise is present;

and determining the selected audio signal based on the comparison.

7. The method of claim 1, wherein combining the first audio signal with the second audio signal to generate the beamformed audio signal comprises:

delaying the second audio signal by an amount corresponding a time for sound to travel a distance between the first microphone and the second microphone;

computing a difference signal representing a difference between the first audio signal and the delayed second audio signal; and equalizing the difference signal to boost a low frequency component of the difference signal.

8. A non-transitory computer-readable storage medium storing instructions for encoding an audio signal captured by a microphone array system in the presence of wind noise, the instructions when executed by one or more processors cause the one or more processors to perform steps including:

capturing at least a first audio signal via a first microphone of a microphone array and a second audio signal via a second microphone of the microphone array;

combining the first audio signal and the second audio signal to generate a beamformed audio signal;

determining a selected audio signal having a lower wind noise metric between the first audio signal and the second audio signal;

processing the selected audio signal to modulate the selected audio signal based on a high frequency carrier signal to generate a high frequency signal; and combining the high frequency signal and the beamformed audio signal to generate an encoded audio signal.

9. The non-transitory computer-readable storage medium of claim 8, where at least one of the first microphone and the second microphone comprise an omni-directional microphone.

10. The non-transitory computer-readable storage medium of claim 8, wherein processing the selected audio signal further comprises:

low pass filtering and level-limiting the selecting audio signal.

11. The non-transitory computer-readable storage medium of claim 8, wherein processing the selected audio signal further comprises:

applying a low pass filter having a cutoff frequency of approximately 4 kHz.

12. The non-transitory computer-readable storage medium of claim 8, wherein the high frequency carrier signal has a frequency of at least 20 kHz.

13. The non-transitory computer-readable storage medium of claim 8, wherein determining the selected audio signal having the lower wind noise metric comprises:

performing a comparison of an energy level of the first audio signal with an energy of the second audio signal within a low frequency range in which wind noise is present;

and determining the selected audio signal based on the comparison.

14. The non-transitory computer-readable storage medium of claim 8, wherein combining the first audio signal with the second audio signal to generate the beamformed audio signal comprises:

delaying the second audio signal by an amount corresponding a time for sound to travel a distance between the first microphone and the second microphone;

computing a difference signal representing a difference between the first audio signal and the delayed second audio signal; and equalizing the difference signal to boost a low frequency component of the difference signal.

15. An audio capture device for encoding an audio signal in the presence of wind noise, the audio capture system comprising:

a microphone array including at least a first microphone to capture a first audio signal and a second microphone to capture a second audio signal;

a processor; and a non-transitory computer-readable storage medium storing instructions that when executed by the processor cause the processor to perform steps including:

combining the first audio signal and the second audio signal to generate a beamformed audio signal;

determining a selected audio signal having a lower wind noise metric between the first audio signal and the second audio signal;

processing the selected audio signal to modulate the selected audio signal based on a high frequency carrier signal to generate a high frequency signal; and combining the high frequency signal and the beamformed audio signal to generate an encoded audio signal.

16. The audio capture device of claim 15, where at least one of the first microphone and the second microphone comprise an omni-directional microphone.

17. The audio capture device of claim 15, wherein processing the selected audio signal further comprises:

low pass filtering and level-limiting the selecting audio signal.

18. The audio capture device of claim 15, wherein processing the selected audio signal further comprises:

applying a low pass filter having a cutoff frequency of approximately 4 kHz.

19. The audio capture device of claim 15, wherein the high frequency carrier signal has a frequency of at least 20 kHz.

20. The audio capture device of claim 15, wherein determining the selected audio signal having the lower wind noise metric comprises:

performing a comparison of an energy level of the first audio signal with an energy of the second audio signal within a low frequency range in which wind noise is present;

and determining the selected audio signal based on the comparison.

21. The audio capture device of claim 15, wherein combining the first audio signal with the second audio signal to generate the beamformed audio signal comprises:

delaying the second audio signal by an amount corresponding a time for sound to travel a distance between the first microphone and the second microphone;

computing a difference signal representing a difference between the first audio signal and the delayed second audio signal; and equalizing the difference signal to boost a low frequency component of the difference signal.

* * * * *